United States Patent [19]

Crouse et al.

[11] 4,396,837

[45] Aug. 2, 1983

[54] TENSILE FORCE ISOLATION SYSTEM

[75] Inventors: Ronald J. Crouse, McKinney; William Frost, Lewisville, both of Tex.

[73] Assignee: Crown Semiconductor, Inc., McKinney, Tex.

[21] Appl. No.: 232,365

[22] Filed: Feb. 6, 1981

[51] Int. Cl.[3] ..... H01R 4/10

[52] U.S. Cl. ..... 250/239; 174/135; 339/107

[58] Field of Search ..... 250/239; 174/135; 339/107

[56] References Cited

U.S. PATENT DOCUMENTS 3,272,913 9/1966 Crimmins et al. ..... 339/107 X 3,550,066 12/1970 Cootes ..... 339/107 X 4,256,360 3/1981 Debaigt ..... 339/107 X

*Primary Examiner*—David C. Nelms

*Assistant Examiner*—Darwin R. Hostetter

*Attorney, Agent, or Firm*—Richards, Harris & Medlock

[57] ABSTRACT

An assembly of electrical components having electrical leads extending from a housing having channels for the leads extending through the end of the housing. The lead channels are of a depth about equal to the diameter of the leads with beveled bottom surface portions to engage the leads. A cover for the housing has protrusions on the inner face of the housing overlying each of the lead channels and the beveled portions and each dimensioned to interfere with the leads in the channels when the cover is secured to the housing.

9 Claims, 4 Drawing Figures

TENSILE FORCE ISOLATION SYSTEM

TECHNICAL FIELD

This invention relates to a mounting arrangement wherein leads from electrical elements are anchored to shield the elements from tensile forces.

BACKGROUND ART

Systems superficially similar to the present invention have heretofore been made and sold. Such prior art devices, however, have suffered difficulties in the fact that tensile forces on leads extending from a unit housing electrical components have been applied directly to the components rather than being positively shielded therefrom. The present invention is an improvement over prior art systems in providing structure which mechanically invades electrical insulation of leads to transfer tensile forces from the leads to the housing of the components rather than to the components themselves.

DISCLOSURE OF THE INVENTION

This invention relates to an assembly in which electrical components have a plurality of leads extending therefrom. A housing is provided for the components and has channels for electrical lead wires. The channels extend through the end of the housing. The channels are of a depth about equal in diameter of the leads and have beveled bottom surface portions extending transversely of said channels for engaging the leads. A cover for the housing has protrusions on the inner face thereof overlying each of the lead channels and the beveled portions and dimensioned to interfere with the leads in the channels when the cover is secured to the housing thereby to anchor the leads and shield the components from tensile forces on the leads.

BRIEF DESCRIPTION OF THE DRAWINGS

For a more complete understanding of the present invention, reference may now be had to the following description taken in conjunction with the accompanying drawings in which.

DETAILED DESCRIPTION

Figure 1:
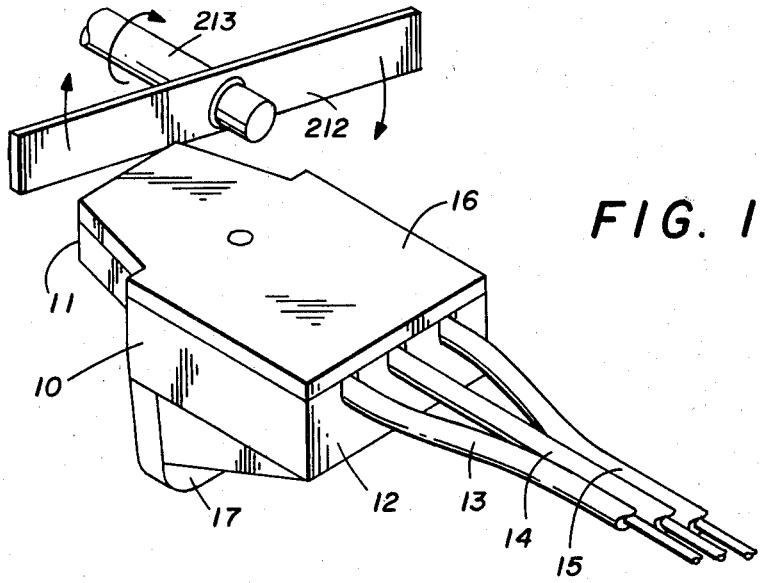
FIG. 1 is a perspective view of an embodiment of the invention.

Referring to FIG. 1, the invention will be described as applied to a light source-light detector assembly in housing 10, shown with the front end 11 thereof facing a rotating vane or disc sector 212 mounted on and driven by a shaft 213.

As will be explained in this exemplary system, a light source and a light detector are mounted in housing 10 adjacent to a window in the end 11 facing the vane 212. As vane 20 rotates in front of the window, light from the source in housing 10 is reflected back to the light detector housing 10 from the surface of blade 212, thereby producing a pair of pulses from the light sensor for each revolution of the blade 212. In a typical installation, the system may serve as a transducer to provide a train of output pulses, the rate of which is an indication of the speed at which shaft 213 is rotating.

Housing 10 has a plurality of lead slots in the rear end 12. In the embodiment shown, three leads 13, 14, and 15 extend from housing 10. Housing 10 is also provided with a cover plate 16 and an integral mounting flange 17.

The unit is illustrated in a typical installation and form a part of a speedometer or odometer system in an automobile. When mounted by way of flange 17, the unit could be subject from time to time with tension on leads 13–15. It is a purpose of the present invention to provide a housing in which leads 13–15 are so anchored as to shield sensitive components in housing 10 from tensile forces that might purposely or accidentally be applied to the leads.

Figure 2:
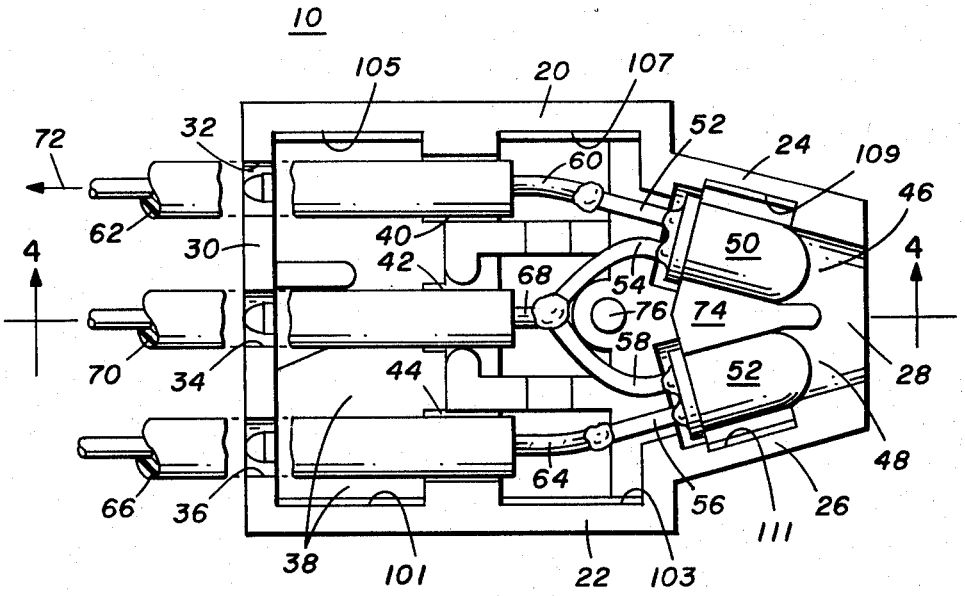
FIG. 2 is a top view of the unit of FIGS. 1 and 2 with the cover plate removed.

Referring now to FIG. 2, the housing 10 is viewed from the top with the cover 16 of FIG. 1 removed and with the bulbs and their leads in place. As shown in FIG. 2, housing 10 has a left side wall 20, and a right side wall 22. The side walls having angled portions 24 and 26 respectively leading to a window 28. Housing 10 also has a rear wall 30 in which are formed three lead receiving slots 32, 34, and 36. Housing 10 also has a bottom panel 38 which is molded integrally with the side walls 20, 22, 24, 26, and 30. Also integral with the system thus far described is a slotted transverse platform which extends to leads 13–15 and which has up facing bottom surfaces 40, 42, and 44. Near the front window 28 are a pair of recesses 46 and 48 in which bulbs 50 and 52 respectively are nested. Bulb 50, for example, may be a light emitting device and bulb 52 may comprise a photosensor. The light source 50 includes a pair of electrical leads 52 and 54. The sensor includes a pair of leads 56 and 58. Lead 52 is connected to a conductor 60 which is covered with a cylindrical body of insulation 62. Similarly, the photodiode lead 56 is connected to a conductor 64 which is covered with a cylindrical body 66 of insulation. Leads 54 and 58 are connected together and to a conductor 68 which, in turn, is covered with a cylindrical body 70 of electrical insulation.

In accordance with the present invention, the slots 32, 34, and 36 are made of width corresponding to the diameter of the insulation bodies 62, 70, and 66 respectively. The bottom surfaces of the slots 32, 34, and 36 are chisel shaped or beveled and the depth of the slots 32, 34, and 36 is about equal the diameter of the insulation 62, 70, and 66. The slots having bottom surfaces 40, 42, and 44 are each of width slightly greater than the diameter of the insulation bodies 60, 70, and 66 respectively.

The present invention provides structure which serves to isolate bulbs 50 and 52 from tensile forces such as might be applied to the leads in the direction of arrow 72. This is done by structure on a flat plate cover 16 for housing 10. Cover 16 has working bosses extending from the lower surface at points in registration with the slots 32, 34, and 36 and at points directly overlaying the surfaces 40, 42, and 44. Housing 10 and cover 16 are injection molded ABS plastic devices which are utilized by placing cover 16 over the housing 10 shown in FIG. 2 and sealing the same by sonic welding in manner well known. When this is done, insulation bodies 62, 70, and 66 are somewhat impaled or invaded by bosses on the underside of cover 16 immediately above the surface 40, 42, and 44 respectively. Further, the insulation is invaded by bosses on cover 16 overlying the slots 32, 34, and 36. By this means, the conductors 60, 64, and 68 are rigidly anchored in housing 10 by invading or deforming the insulation when cover 16 acts with the lead supporting surfaces formed in housing 10.

Not mentioned heretofore is the presence of a baffle 74 lying between bulbs 50 and 52 and extending forward of both bulbs so that light transmission between the bulbs can take place solely by way of window 28. That is, there will be no output from the photodiode 52 unless there is a reflector in front of the window 28. Further, a cylindrical post 76 is provided to assist in registration of cover 16 on housing 10.

Figure 3:
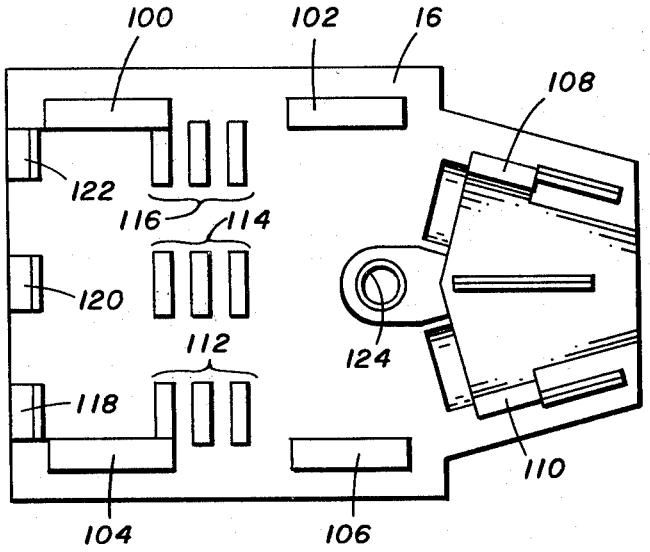
FIG. 3 is a view of the bottom surface of the cover plate of FIGS. 1 and 2.

Referring now to FIG. 3, cover 16 is shown as viewed from the bottom surface thereof. It will be noted that cover 16 is of the same shape as the body 10. It is provided with four rectangular bosses 100, 102, 104, and 106 which extend downward from the bottom face of the cover 16 for registration in notches 101, 103, 105, and 107 of the body 10 as seen in FIG. 2 to accurately position cover 16 over the body 10. Two additional rectangular bosses 108 and 110 are provided near the window 28. They are brought into registration in notches 109 and 111 respectively of housing 10.

A set of three protrusions 112 is positioned to overlie the surface 40. A second set of three protrusions 114 is located as to overlie the surface 42. A third set of three protrusions 116 is positioned to overlie the surface 44.

Transverse beveled projections 118, 120, and 122 are positioned to overlie slots 32, 34, and 36 respectively. Projections 112 squeeze the insulation 62 down onto the surface 40. The projections 114 squeeze the insulation 70 down onto the surface 42. The three projections 116 squeeze the insulation down onto the surface 44. Similarly, transverse projections 118, 120, and 122 serve to deform the insulation 62, 70, and 66 respectively at the sites represented by the slots 32, 34, and 36.

Cover 16 is provided with a hole 124 which receives the post 76 of FIG. 2 for orientation and positioning housing 10 and cover 16.

Figure 4:
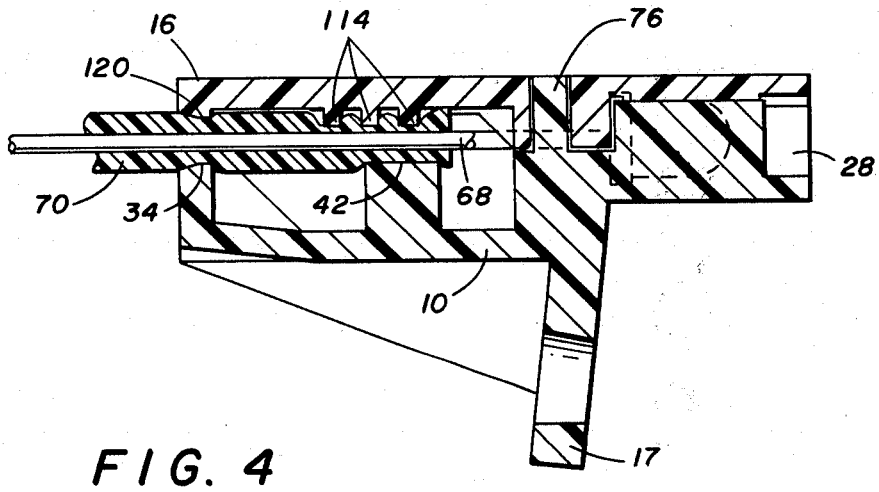
FIG. 4 is a sectional view taken along lines 4—4 of FIG. 2.

The lead anchoring action achieved by the present invention is illustrated in FIG. 4. More particularly, conductor 68 extends from its connection with the leads from bulbs 50 and 52 of FIG. 2 to and beyond the rear slot 34. As will be observed, the bottom of slot 34 is beveled or chisel shaped. Similarly, the protrusion 120 is beveled so that the insulation 70 is invaded or compressed between the beveled surfaces 34 and 120. Similarly, bosses 114 serve to compress the insulation and force it downward onto the surface 44, causing some lateral movement of the insulation so that the insulation is forced outward against the confronting side walls of the slot in which the conductor is positioned. As a result, any tensile forces on any of leads 13–15, FIG. 1, will be transferred to housing and lid structure and the fragile leads of bulbs 50 and 52 will essentially be isolated from such forces.

It will now be apparent that the anchoring structures herein provided may be employed with any element where isolation from external tensile forces is decided and is not limited to use with the source-sensor combination utilized in the above description to portray the invention.

Having described an embodiment of the invention as illustrated in the accompanying drawings and described in the foregoing detailed description, it will be understood that the invention is not limited to the embodiment disclosed, but is capable of numerous rearrangements, modifications and substitutions without departure from the scope of the invention.

We claim:

1. An assembly for isolating tensile forces on insulated electrical conductors which are anchored to components to be housed which comprises:

a. an open top housing for receiving said components having an end wall with at least one conductor channel receiving one of said conductors as it extends into said housing through said end wall, said channel being of depth about equal in diameter of said insulated conductor and having at least one beveled bottom surface portion extending transverse to said channel and positioned to engage the insulation on said conductor when in said channel; and b. a cover for closure of the open top of said housing having transverse protrusion means on the bottom face thereof overlying said beveled portion of said channel and dimensioned to extend into said channel and engage said insulation when said cover is secured to said housing thereby to anchor said insulated conductor to said housing and isolate said components from external tensile forces on said conductor.

2. The combination set forth in claim 1 wherein said cover is a flat plate adapted for sonic welding to said housing.

3. The combination set forth in claim 1 in which a raised transverse bottom surface portion of said housing and a plurality of transverse protrusions on said cover engage said insulation of said conductor at locations inwardly in said housing of said beveled bottom surface portion.

4. The combination set forth in claim 3 in which said plurality of protrusions overlay said bottom surface portion in juxtaposed relation and spaced apart less than the diameter of the insulation on said conductor.

5. An assembly for isolating tensile forces on insulated electrical conductors which are anchored to components to be housed which comprises:

a. an open top housing for receiving said components having an end wall with a plurality of conductor channels each receiving one of said conductors as they extend into said housing through said end wall, said channels being of depth about equal in diameter of said insulated conductors and each having at least one beveled bottom surface portion extending transverse to said channels positioned to interface with seating of insulation on said conductors when in said channels; and b. a cover for closure of the open top of said housing having transverse protrusion means on the bottom face thereof overlying said beveled portions of said channels and dimensioned to extend into said channels and engage said insulation when said cover is secured to said housing thereby to anchor said insulated conductors to said housing and isolate said components from external tensile forces on said conductors.

6. The combination set forth in claim 5 wherein said cover is a flat plate adapted for sonic welding to said housing.

7. The combination set forth in claim 5 in which transversely raised bottom surface portions of said housing and a plurality of additional transverse protrusions on said cover engage insulation on each of said conductors at locations inwardly in said housing and spaced from said beveled bottom surface portions.

8. The combination set forth in claim 7 in which said plurality of protrusions overlay said raised bottom surface portions in juxtaposed relation and spaced apart less than the diameter of the insulation covering said conductor.

9. A tension isolated reflective optical assembly comprising:

a. an open topped housing having conductor channels extending through one end of said housing with marginal inwardly directed beveled bottom surface portions extending transversely to said channels and with a pair of side-by-side bulb bays opening to the other end of said housing with structure optically to isolate one of said bays from the other;

b. an assembly of electrical components including a pair of cooperating bulbs, one bulb in each of said bays with insulated electrical conductors extending from said bulbs and lying within said channels; and c. a cover for said housing having protrusions on the innerface thereof, one of which protrusions overlies each of said beveled portions, said protrusions being dimensioned to interfere with insulation on said conductors when said cover is secured to said housing, thereby to anchor said conductors and isolate said bulbs from external tensile forces on said conductors.

* * * * *